United States Patent [19]

Eistrat

[11] 4,198,807

[45] * Apr. 22, 1980

[54] NON-SPECULAR WIRE ROPE AND METHOD OF MAKING SAME

[76] Inventor: Thomas Eistrat, 1020 S. Almansor St., Alhambra, Calif. 91801

[ * ] Notice: The portion of the term of this patent subsequent to Apr. 17, 1996, has been disclaimed.

[21] Appl. No.: 12,168

[22] Filed: Feb. 14, 1979

Related U.S. Application Data

[63] Continuation-in-part of Ser. No. 869,850, Jan. 16, 1978, Pat. No. 4,149,367.

[51] Int. Cl.[2] ..... D07B 7/12

[52] U.S. Cl. ..... 57/212; 57/6; 57/223; 57/314

[58] Field of Search ..... 51/319-321, 51/DIG. 10, 410; 174/128 R, 130 R; 15/88, 209; 57/1, 6, 7, 9, 13, 200, 210, 212, 213, 214, 215, 223, 232, 311, 314; 29/DIG. 36, DIG. 39; 427/170

[56] References Cited

U.S. PATENT DOCUMENTS

| | | | |
|---|---|---|---|
| 1,798,316 | 3/1931 | Dreisbach | 51/410 X |
| 2,042,824 | 6/1936 | Brazier | 57/232 X |
| 2,071,709 | 2/1937 | Riddle | 57/311 X |
| 3,061,997 | 11/1962 | Haugwitz . | |
| 3,124,927 | 3/1964 | Mann et al. | 57/9 |
| 3,217,838 | 11/1965 | Peterson et al. . | |
| 3,413,792 | 12/1968 | Werdenberg | 57/9 |
| 3,496,285 | 2/1970 | Slethel | 174/130 |
| 3,526,530 | 9/1970 | Sams | 427/170 X |
| 3,760,093 | 9/1973 | Pemberton | 174/128 R |
| 3,899,365 | 8/1975 | Guy | 57/314 X |
| 3,906,672 | 9/1975 | Kobayashi | 51/410 |

*Primary Examiner*—Donald Watkins

[57] ABSTRACT

Wire rope is made non-specular by making the wire for the top layer of wire rope non-specular before the wire is stranded into a wire rope. This method and the product thereof are new to the wire rope art. Such wire rope is not contaminated by detrimental abrasives or other products that would become embedded into the wire rope should it be made non-specular by abrasive blasting or other methods after the wire rope is completely stranded. Wire rope that is not conspicious is preferred in many locations.

10 Claims, 1 Drawing Figure

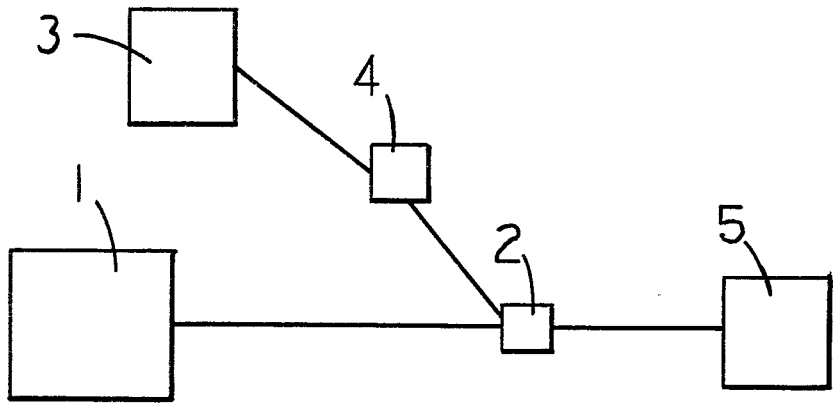
3
4
1
2
5

NON-SPECULAR WIRE ROPE AND METHOD OF MAKING SAME

This is a continuation-in-part of applicant's allowed application Ser. No. 869,850, filed Jan. 16, 1978 entitled Non-Specular Conductor and Method of Making Same.

BACKGROUND OF THE INVENTION

1. Field of the Invention

This invention is directed to non-specular uncontaminated wire rope and the methods of making same. Such wire rope is herein defined to mean galvanized wire rope used for standing service, where no bending is required, as guys, rigging, towing and mooring lines; galvanized steel strand; transmission or haulage rope; elevator rope; track strand for aerial tramways; locked wire cable; and other wire rope and wire cable.

2. Description of Prior Art

Wire rope has been painted for better appearance. Stranded wire has been made in the form of non-specular conductor and made on the same machines as used for making wire rope.

SUMMARY OF INVENTION

Applicant's U.S. Pat. No. 4,149,367, issued Apr. 17, 1979, application filed Jan. 16, 1978 entitled Non-Specular Conductor and Method of Making Same is incorporated herein by reference thereto, including all of the specification, drawings, and claims.

Wire rope has been painted to improve its appearance in an environment. This invention relates to the disappearance of its appearance by making it non-specular. And further, this invention adopts each and all methods of the invention incorporated herein by reference as methods for making non-specular wire rope. This invention makes wire rope non-specular by making the wire for the top layer of wire rope non-specular before the wire is stranded into a wire rope. It is a new method for and a new product of wire rope. This wire rope is not contaminated by detrimental abrasives or other products that would become embedded into wire rope during manufacture should it be made non-specular by abrasive blasting or other methods after the wire rope is completely stranded.

This invention makes non-specular wire rope by a method which comprises making the wire for a top layer of strands non-specular before feeding said wire thru a final closing block on a wire rope strander; and then completing a stranding of the wire rope so that the completed wire rope is non-specular.

This invention method also includes making the non-specular wire thereof non-specular by abrasive blasting.

This invention method also includes making the non-specular wire thereof sufficiently non-specular by rolling on a non-specular finish.

This invention method also includes making the non-specular wire therof sufficiently non-specular by anodizing with a color which substantially blends into the background against which it would be visible when installed.

This invention method also includes making the non-specular wire thereof sufficiently non-specular by adding a delustrant to the lubricant remaining on said wire after wire drawing.

This invention also includes a product of wire rope, or products, made by each and every method aforesaid stated for non-specular wire rope.

BRIEF DESCRIPTION OF THE DRAWING

Block 1 shows incompletely stranded wire rope that is to be covered with a top layer of non-specular wire shown as block 4. Block 3 shows a means for making the non-specular wire of a non-specular wire rope. The non-specular wire from block 3 is wound onto bobbins for the top layer which is shown as block 4. These bobbins of non-specular wire are then placed into a wire rope stranding machine and feed thru a closing block 2 on the stranding machine so that the stranding of the non-specular wire rope is completed; and then wound onto a wire rope reel shown as block 5.

DESCRIPTION OF THE PREFERRED EMBODIMENTS

A description of a preferred embodiment of this invention is the making of a non-specular wire rope by making the top layer of said rope non-specular by abrasive blasting means before it is stranded into a wire rope. The wire rope product of aforesaid method is a preferred embodiment.

This invention having been described in its preferred embodiments, it is clear that it is susceptible to numerous modifications and embodiments within the ability of those skilled in the art and without the exercise of the inventive faculty. Accordingly, the scope of this invention is defined by the scope of the following claims.

I claim:

1. A method of making non-specular wire rope, which comprises:

(a) making wire for a top layer of strands non-specular before feeding said wire thru a final closing block on a strander, and (b) then completing a stranding of the wire rope so that the completed wire rope is non-specular.

2. The method of claim 1, further comprising: making the non-specular wire thereof sufficiently non-specular by abrasive blasting.

3. The method of claim 1, further comprising: making the non-specular wire thereof sufficiently non-specular by rolling on a non-specular finish.

4. The method of claim 1, further comprising: making the non-specular wire thereof sufficiently non-specular by anodizing with a color which substantially blends into the background against which it would be visible when installed.

5. The methods of claim 1, further comprising: making the non-specular wire thereof sufficiently non-specular by adding a delustrant to the lubricant remaining on said wire after wire drawing.

6. A product made by the method of claim 1.

7. A product made by the method of claim 2.

8. A product made by the method of claim 3.

9. A product made by the method of claim 4.

10. A product made by the method of claim 5.

* * * * *